US005652417A

United States Patent [19]

Tsai et al.

[11] Patent Number: 5,652,417

[45] Date of Patent: Jul. 29, 1997

[54] ELECTRIC SWITCH HAVING IMPROVED LEVER OPERATOR ARRANGEMENT

[75] Inventors: David Y. Tsai, Arab; Paul W. Lombard, Huntsville; Lucian J. Copeland, Arab, all of Ala.; Denis J. Leveque; Michael T. Little, both of Milwaukee, Wis.

[73] Assignee: Eaton Corporation, Cleveland, Ohio

[21] Appl. No.: 546,969

[22] Filed: Oct. 23, 1995

[51] Int. Cl.[6] ..... H01H 21/00

[52] U.S. Cl. ..... 200/6 R; 200/294; 200/335

[58] Field of Search ..... 200/4, 5 R, 6 R, 200/17 R, 11 R–11 TW, 61.85, 61.27, 61.54, 293.1, 294, 332, 332.2, 335, 336, 567; 318/50.9–50.18, 280; 388/838, 839, 840

[56] References Cited

U.S. PATENT DOCUMENTS

| | | | |
|---|---|---|---|
| 3,286,047 | 11/1966 | Heide | 200/11 TW |
| 3,637,967 | 1/1972 | Braun | 200/155 R |
| 3,719,785 | 3/1973 | Kendall et al. | 200/11 TW |
| 4,277,661 | 7/1981 | Riess | 200/157 |
| 4,349,758 | 9/1982 | Grant, Jr. et al. | 310/68 A |
| 4,778,953 | 10/1988 | Kato | 200/11 G |
| 4,903,318 | 2/1990 | Nagata | 388/840 |
| 4,968,922 | 11/1990 | Bittel | 318/280 |
| 5,196,662 | 3/1993 | Hofmann | 200/61.54 |

FOREIGN PATENT DOCUMENTS

| | | | |
|---|---|---|---|
| 4368727 | 12/1992 | Japan | 21/8 |

*Primary Examiner*—Michael L. Gellner
*Assistant Examiner*—Michael A. Friedhofer
*Attorney, Agent, or Firm*—Larry G. Vandezande

[57] ABSTRACT

A lever operated rotary reversing switch wherein a lever is snap-fit attached to the switch housing with a portion of the lever inserted under an overhang on the housing to maintain that portion of the lever against the exterior surface. A detent is provided between the overhang and the end of the lever to direct the forces longitudinally in the plane of the lever. A rotor plate located exteriorly of the housing is connected to the rotor by an axial shaft, and an eccentric received in a slot in the lever for providing a driving coupling between the lever and internal contact mechanism is located on the exterior surface of the rotor plate.

14 Claims, 2 Drawing Sheets

ELECTRIC SWITCH HAVING IMPROVED LEVER OPERATOR ARRANGEMENT

BACKGROUND OF THE INVENTION

This invention relates to lever operated electric switches wherein pivotal movement of a lever operates switching contacts within a switch housing. More particularly, this invention relates to an improvement of the lever operator arrangement for a rotary switch of the type used to reverse the polarity of electric power at the output terminals of the switch. Switches of this type are commonly referred to as reversing switches and are used in controls for portable electric tools.

Reversing switches may be constructed as an integral part of a portable tool trigger switch or may be a discrete switch unit mounted on the top of a trigger switch. The reversing switch contact mechanism is commonly a rotary mechanism, although the lever operator system of this invention could be employed to operate a reciprocating slide switch. The contact mechanism commonly has an eccentric portion of the movable contact carrier projecting within or through an arcuate slot in the switch housing for engagement by the lever operator. The lever is pivotally mounted to the switch housing, commonly by a rivet that is also used to attach the reversing switch to the trigger switch. Such arrangement significantly complicates the assembly procedure. The portion of the lever that engages the movable contact carrier eccentric may deflect away from the reversing switch housing, reducing the efficiency of the engagement with the movable contact carrier. Moreover, deflection of the lever away from the switch housing uncovers the slot through which connection with the movable contact carrier is effected, increasing the chances for foreign matter to enter the switch. Detent mechanisms for the lever comprising spring loaded balls in the housing or protuberances on the housing or lever cooperating with recesses in the opposite member also tend to deflect the lever away from the switch housing surface, uncovering the slot and rendering the switch more susceptible to the entry of foreign matter through the slot.

SUMMARY OF THE INVENTION

This invention provides a lever operated electric switch wherein the housing is provided with an overhang and the lever is snapped into pivotable attachment to the housing, a portion of the lever being inserted under the overhang to maintain the lever slidably disposed against the housing. The overhang and a distal end of the lever portion cooperate to provide a detent that generates forces directed in the plane of the lever. A rotary contact mechanism includes an eccentric located externally of the switch housing on a rotor plate that attaches to a projecting axial shaft of the internal rotor. The rotor plate is significantly larger in diameter than is a hole in the housing for the rotor shaft to provide improved sealing against ingress of foreign matter through the hole for the contact mechanism-to-lever connection.

The invention, its advantages and features will become more readily apparent when reading the following description and appended claims in conjunction with the accompanying drawings.

DETAILED DESCRIPTION OF THE PREFERRED EMBODIMENT

Figure 1:
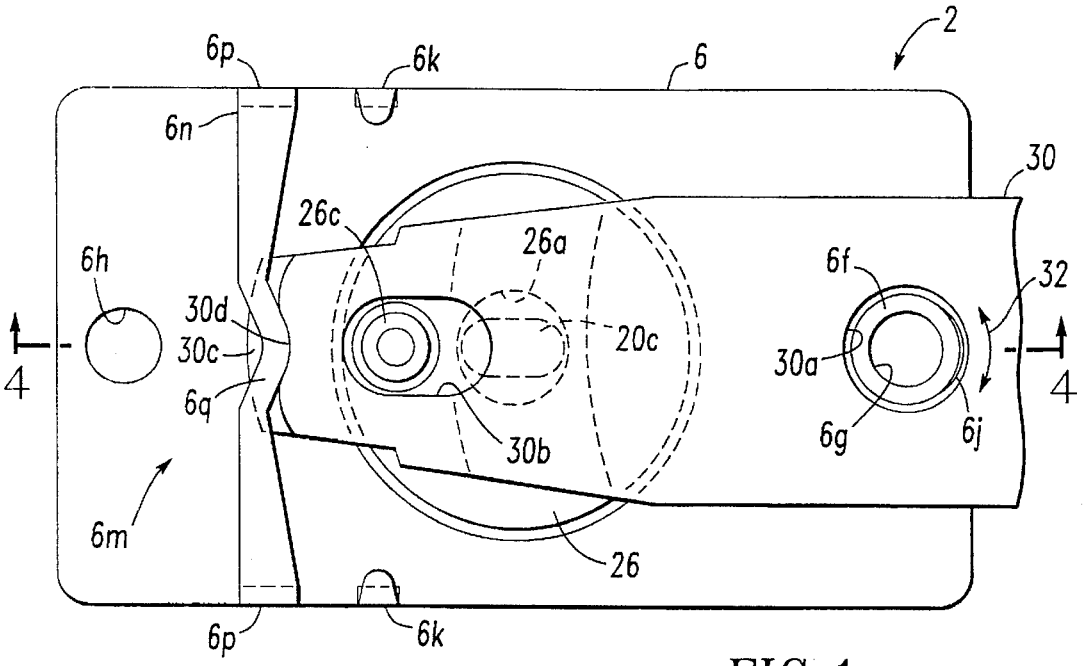
FIG. 1 is a top plan view of a lever operated electric switch constructed in accordance with this invention.
Figure 4:
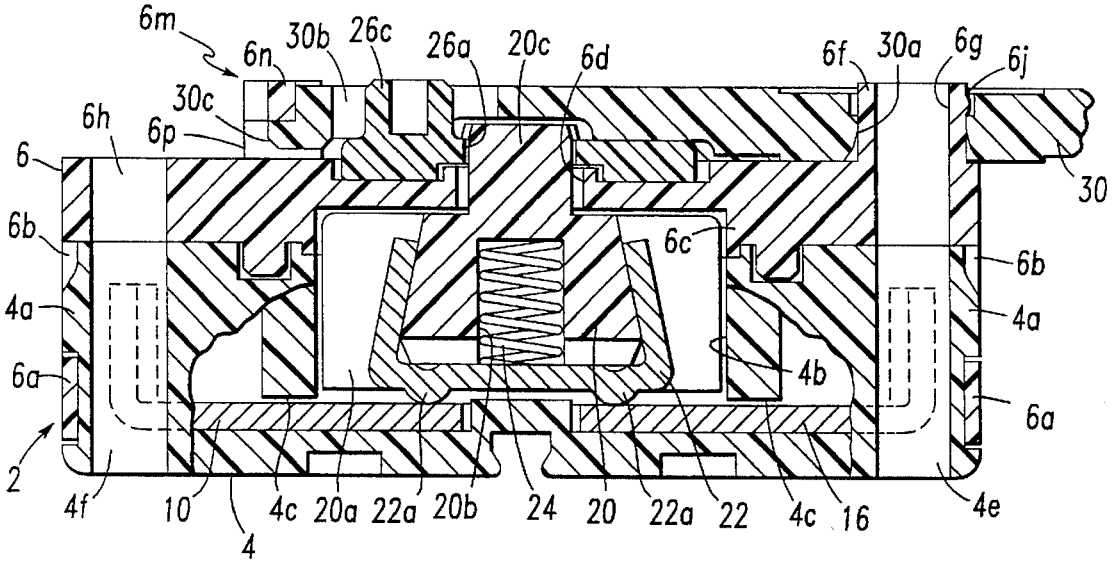
FIG. 4 is a cross sectional view taken generally along line 4—4 in FIG. 1 and drawn to an enlarged scale.
Figure 3:
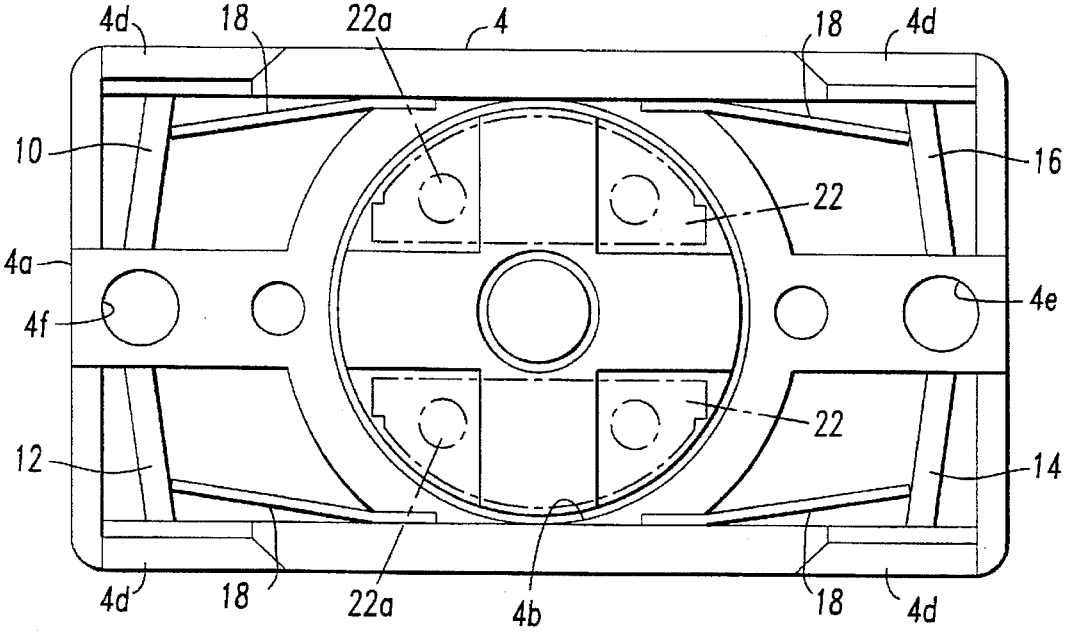
FIG. 3 is a top view of the switch base and stationary contacts with the cover and rotor removed.

A discrete lever operated electric switch 2 is shown as viewed from the top in FIG. 1. Switch 2 is a rotary switch operable to reverse the polarity of current flow at the output terminals relative to the input terminals. With reference also to FIGS. 3 and 4, switch 2 has an insulating housing comprising a molded insulating base 4 and a molded insulating cover 6. Tabs 6*a* depend from cover 6 at the opposite ends and have rectangular openings 6*b* therein to resiliently snap over projections 4*a* on base 4 to secure cover 6 to base 4. Tabs 6*a* are part of respective end walls of cover 6 that close the open ends of base 4.

Figure 2:
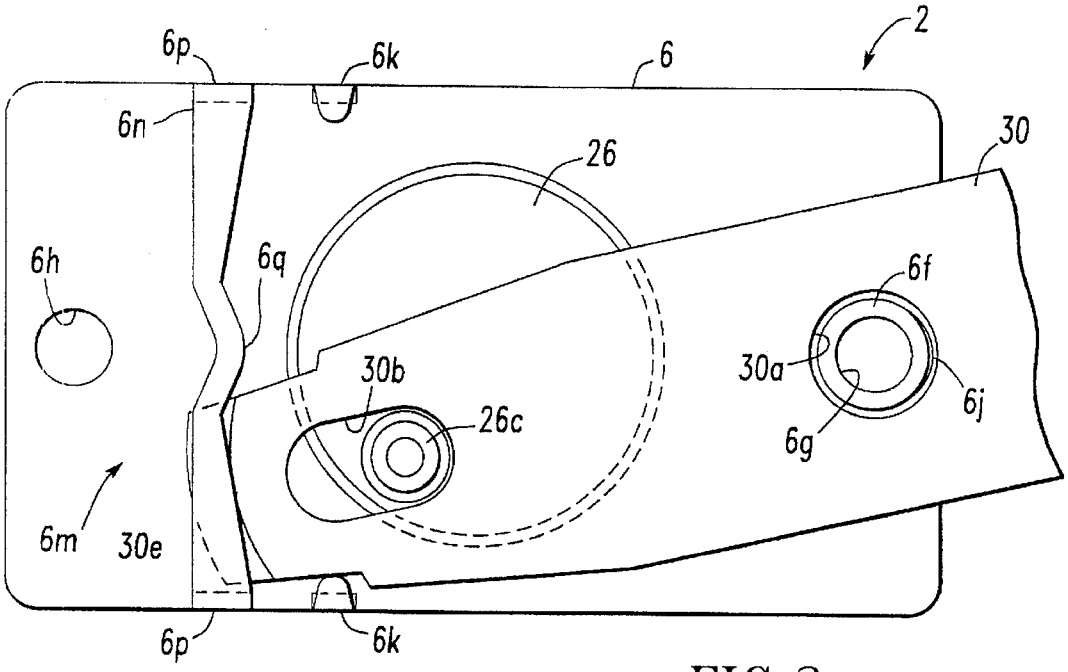
FIG. 2 is a partial top plan view of an alternate embodiment of the lever operated electric switch of this invention.

As seen in FIG. 3, base 4 comprises a cylindrical cavity 4*b* into which four L-shaped stationary contacts 10, 12, 14 and 16 are inserted from the open ends of the base 4 prior to attachment of cover 6. The stationary contacts are disposed within recesses in the bottom of base 4 and project through slots 4*c* (FIG. 4) at the bottom of the arcuate wall surrounding cylindrical cavity 4*b*. Flexible wire retention clips 18 are inserted within narrow slots in base 4 as seen in FIG. 2 and are deflected against the respective upstanding legs of stationary contacts 10–16. Openings 4*d* are provided at each end of the sidewalls of base 4 through which wires from an electric power source and an electric motor may be inserted. The bared ends of such wires are inserted between retention clips 18 and the respective upstanding legs of the stationary contacts in a well known manner to connect the switch 2 in an electric circuit.

A cylindrical rotor 20 molded of insulating material is disposed within cylindrical cavity 4*b* as seen in FIG. 3. Rotor 20 has a pair of slots 20*a* (only one shown, FIG. 4) which receive movable U-shaped bridging contacts 22, each biased outwardly of the respective slot toward the bottom of base 4 by a respective helical compression spring 24 disposed within a blind hole 20*b*. The legs of bridging contacts 22 converge at the outer ends. The sidewalls of slots 20*a* are angularly offset generally parallel to the legs of contacts 22. The movable bridging contacts 22 are forced over the wider lower end of the rotor and are retained so assembled to the rotor by the convergence of the legs. The lower surface of each bridging contact 22 is dimpled downward near the opposite ends to form bosses 22*a* which engage the surface of stationary contacts 10–16.

Cover 6 has a shallow cylindrical recess 6*c* in the exterior surface axially aligned with cavity 4*b*, and an opening 6*d* through the cover on the axis of recess 6*c*. A flatted shaft 20*c* of rotor 20 projects axially upward through opening 6*d* above the exterior surface of cover 6. A rotor plate 26 having a central opening 26*a* shaped complementally to shaft 20*c* is disposed over shaft 20*c* to be non-rotatably attached to rotor 20. It will be noted that plate 26 is significantly larger in diameter than opening 6*d*, and therefore the opening 6*d* is well covered and protected against the passage of foreign material therethrough into the switch.

A boss 26*c*, located eccentrically near the periphery of rotor plate 26, extends upwardly from the upper surface of rotor plate 26 to provide a drive connection for the contact mechanism rotor 20. A post 6*f* extends upwardly from the exterior surface of cover 6 near the right-hand end of the cover as oriented in the drawings. A hole 6*g* extends through the post 6*f* and cover 6 in alignment with a hole 4*e* in base 4 to provide a mounting hole for the switch. A second mounting hole is provided at the other end of the switch by aligned holes 6*h* and 4*f* in the cover and base, respectively. An operating lever 30 is pivotably attached to switch 2 by a hole 30*a*, located between the ends of the lever, being disposed over post 6*f*. The post is provided with a raised semicircular rib 6*j* to provide an interference fit between post 6*f* and hole 30*a*. Forcing lever 30 onto the cover 6 forces hole 30*a* over post 6*f* with a snap fit to secure the lever 30 the cover 6. It is contemplated that other well known snap-on attachment structures could be employed to attach lever 30 to cover 6, e.g. a resilient catch extending axially on the post. The post also could be located on the lever and the hole located in cover 6.

Lever 30 has an elongated opening 30*b* near its left-hand end portion as oriented in the drawings. Opening 30*b* is disposed over boss 26*c* and forms a driving connection between operator lever 30 and rotor 20. As operator lever 30 is pivotally moved clockwise or counterclockwise about post 6*f* in the direction of arrow 32 (FIG. 1) the lever drives rotor plate 26 and rotor 20 clockwise or counterclockwise to effect switching of movable contacts 22 upon stationary contacts 10–16. A pair of stops 6*k* are integrally molded on cover 6 to provide limits to the pivotal movement of lever 30.

An overhang 6*m* is provided on cover 6. Overhang 6*m* is preferably integrally molded on cover 6 and comprises a cross member 6*n* supported at opposite ends by abutments 6*p*. The distal end of lever 30 is stepped to provide a projecting lip 30*c* which is inserted under cross member 6*n* during attachment of the lever to the cover. The overhang retains lever 30 against the exterior surface of cover 6 in good driving engagement with eccentric boss 26*c* and tightly covering opening 6*d*. The end of lever 30 above lip 30*c* has either a V-shaped groove 30*d* (FIG. 1) or an arcuate surface 30*e* (FIG. 2) which cooperates with a resilient projection 6*q* on cross member 6*n* to provide a detent for lever 30. The force of detent 6*q*–30*d* is directed in the plane of lever 30 parallel to the top surface of the cover 6 and therefore does not tend to deflect lever 30 away from the exterior surface of cover 6. The V-shaped groove 30*d* provides a center position for lever 30 and the curvature of the end of lever 30 cooperates with outer peaks of the groove 30*d* to provide left and right detented positions for the lever, maintaining it against the respective stops 6*k*. The arcuate surface 30*e* (FIG. 2) cooperates with the same resilient projection 6*q* to provide a two-position operation.

The foregoing has described a preferred embodiment of the improved operating lever arrangement of this invention. However, it is to be understood that the invention is susceptible to various modifications and embodiments without departing from the appended claims. By way of example, the overhang may be a non-resilient member having a slot facing pivot post 6*f*. The overhang may be a separate member as opposed to being an integral element of the cover, or it may be an inter-engaging structure on the lever and cover that permits sliding movement, but blocks movement of the lever away from the surface of the switch housing. Moreover, the overhang 6*m* could be arranged to extend over the upper surface of lever 30 as opposed to over the projecting lip 30*c* at the end of the lever and that the inclusion of the detent is optional.

We claim:

1. In an electric switch having:

a housing having a wall, an internal chamber on one side of said wall, an exterior surface at an opposite side of said wall, and an opening through said wall extending from said exterior surface into said internal chamber;

switching contacts in said chamber;

an operator lever pivotally attached to said housing, said lever having a portion disposed along said exterior surface;

means extending through said opening drivingly coupling said lever portion and said switching contacts;

the improvement comprising:

interlocking means on said housing and on said lever portion for maintaining said lever portion slidably disposed against said exterior surface.

2. The electric switch defined in claim 1 wherein said interlocking means comprises an overhang on said housing spaced from said exterior surface and said lever portion is disposed between said overhang and said exterior surface.

3. The electric switch defined in claim 2 wherein said operator lever portion comprises a distal end remote from said pivotal attachment of said lever to said housing, and said overhang overlies said distal end.

4. The electric switch defined in claim 3 wherein said overhang comprises a pair of spaced projections on said housing and a bar mounted to and extending between said projections.

5. The electric switch defined in claim 4 wherein said housing comprises a plastic molding and said projections and said bar are integrally molded elements of said housing.

6. The electric switch defined in claim 5 wherein said housing comprises a second pair of spaced projections spaced from said first pair of spaced projections, said second pair of spaced projections limiting pivotal movement of said operating lever.

7. The electric switch defined in claim 4 wherein said bar and said distal end comprise cooperable detent means.

8. The electric switch defined in claim 7 wherein said bar is an integrally molded element having a resilient section comprising said cooperable detent means on said bar.

9. The electric switch defined in claim 8 wherein force applied to said lever by said cooperable detent means is directed in a plane of said lever in which said lever pivots.

10. The electric switch defined in claim 1 wherein said switching contacts are rotatably operated within said chamber, and said means coupling said lever portion and said switching contacts comprises an eccentric.

11. The electric switch defined in claim 10 wherein said switching contacts comprise a carrier rotatably mounted in said chamber, said carrier having a shaft projecting axially and extending through said opening, and a rotor plate secured to said shaft at said exterior surface, said plate comprising said eccentric.

12. The electric switch defined in claim 11 wherein said rotor plate is larger than said opening, covering said opening for blocking ingress of foreign material into said chamber through said opening.

13. The electric switch defined in claim 1 wherein said lever is snap-fit attached to said housing.

14. The electric switch defined in claim 13 wherein said housing comprises an upstanding post and said operator lever comprises an opening for receiving said post, said post having means deflectable by forcing said lever opening thereover for effecting said snap-fit attachment.

* * * * *